United States Patent [19]

Sunami et al.

[11] Patent Number: 4,561,909

[45] Date of Patent: Dec. 31, 1985

[54] METHOD OF MANUFACTURING T-3 GRADE LOW TEMPER BLACK PLATES

[75] Inventors: Hideo Sunami, Chiba; Hideo Kuguminato; Yoshio Izumiyama, both of Yotsukaido; Fumiya Yanagishima, Ichihara; Takashi Obara; Kazuo Mochizuki, both of Chiba, all of Japan

[73] Assignee: Kawasaki Steel Corporation, Kobe, Japan

[21] Appl. No.: 551,503

[22] Filed: Nov. 14, 1983

Related U.S. Application Data

[63] Continuation of Ser. No. 369,929, Apr. 19, 1982, abandoned.

[30] Foreign Application Priority Data

Aug. 13, 1981 [JP] Japan ..... 56-125997

[51] Int. Cl.[4] ..... C21D 9/46

[52] U.S. Cl. ..... 148/12 D

[58] Field of Search ..... 148/12 C, 12.3, 12 D

[56] References Cited

U.S. PATENT DOCUMENTS

| | | | |
|---|---|---|---|
| 4,023,987 | 5/1977 | Nomura et al. | 148/12 D |
| 4,040,873 | 8/1977 | Nakaoka et al. | 148/12 C |

FOREIGN PATENT DOCUMENTS

| | | | |
|---|---|---|---|
| 95122 | 8/1978 | Japan | 148/12.3 |
| 73827 | 6/1980 | Japan | 148/12.3 |
| 152129 | 11/1980 | Japan | 148/12.3 |
| 9355 | 1/1981 | Japan | 148/12 C |

*Primary Examiner*—Wayland Stallard

*Attorney, Agent, or Firm*—Balogh, Osann, Kramer, Dvorak, Genova & Traub

[57] ABSTRACT

A method of manufacturing T-3 grade low temper blackplates having an excellent corrosion resistance by a continuous annealing process. In this method, after a continuously cast slab of low carbon aluminum killed steel consisting of 0.02–0.09% of C, not more than 0.04% of Si, 0.15–0.40% of Mn, 0.003–0.02% of soluble Al, not more than 0.0040% in total of N and the balance of Fe and inevitable impurities is subjected to hot rolling, coiled at a temperature of less than 580° C., pickled and subjected to cold rolling, the resulting cold-rolled strip is subjected to such a continuous annealing that the strip is maintained at a temperature above 680° C. for at least 20 seconds, quenched up to a temperature below 500° C. at a cooling rate of 10°–500° C./sec, maintained at a temperature of 350°–500° C. for at least 20 seconds and cooled to room temperature.

1 Claim, 5 Drawing Figures

METHOD OF MANUFACTURING T-3 GRADE LOW TEMPER BLACK PLATES

This application is a continuation of application Ser. No. 369,929 filed Apr. 19, 1982 now abandoned.

This invention relates to a method of manufacturing low temper blackplates, and more particularly to a method of manufacturing T-3 grade low temper blackplates having an excellent corrosion resistance wherein a continuously cast slab of low-carbon aluminum killed steel is subjected to hot rolling, cold rolling and continuous annealing in the conventional manner and further to overaging under continuous annealing.

In general, the tempering degree of tinplates and blackplates is defined by a value of Rockwell hardness ($H_R$ 30T) according to JIS G 3303, which is classified into seven grades, T-1 ($H_R$ 30T:46~52), T-2 (50~56), T-2½ (52~58), T-3 (54~60), T-4 (58~64), T-5 (62~68) and T-6 (67~73).

Heretofore, low temper blackplates having a value of not more than T-3 grade have mainly been manufactured by box annealing process for a long time. In this case, however, the production efficiency and heat efficiency are low and also the homogeneity of the material in the resulting blackplate is poor.

Moreover, it is known that if continuous annealing process is used instead of the box annealing process at the manufacturing step of such a low temper blackplate, the production efficiency and heat efficiency are improved and also the shape retention is good and the material of the resulting blackplate is homogeneous, i.e. the material variation produced in the longitudinal and widthwise directions of the blackplate due to heat hysteresis can be reduced. However, low temper blackplates having the same quality as in the box annealing process can not be obtained by the continuous annealing process, so that the adoption of the continuous annealing process is yet on the way of practical use at the manufacturing step of the low temper blackplate.

In Japanese Patent Application Publication No. 48,574/80, there have been proposed two methods, one of which being a method of manufacturing a soft steel plate applicable for surface treatment wherein a slab consisting of not more than 0.12% of carbon, 0.05–0.60% of manganese, 0.01–0.20% of acid-soluble aluminum, 0.002–0.020% of nitrogen and the balance of iron and inevitable impurities is hot-rolled at a finishing temperature of from 700° C. to Ar 3 transformation, cold-rolled at a reduction ratio of 40–95%, raised to a temperature above recrystallization temperature for 5 seconds to 10 minutes and maintained at this temperature for 5 seconds to 10 minutes, annealed to cool from the above temperature to a temperature below 500° C. over a time of not more than 10 minutes and then subjected to a leveling or temper rolling, and the other being a method of manufacturing a soft steel plate applicable for surface treatment wherein a slab consisting of not more than 0.12% of carbon, 0.05–0.60% of manganese, 0.01–0.20% of acid-soluble aluminum, 0.002–0.020% of nitrogen and the balance of iron and inevitable impurities is hot-rolled at a finishing temperature of from 700° C. to Ar 3 transformation, cold-rolled at a reduction ratio of 40–95%, maintained at a temperature above recrystallization temperature for 5 seconds to 10 minutes, annealed to cool from the above temperature to a temperature below 500° C. over a time of not more than 10 minutes, overaged at a temperature of 300°–500° C. for 10 seconds to 10 minutes and then subjected to a leveling or temper rolling. In any case, the slab to be used is a substantially continuous cast slab and a continuous annealing is adopted as the annealing process.

Furthermore, the above literature discloses that steel plates having hardnesses of T-1 to T-6 grades are obtained by subjecting continuously cast Al-killed steel slabs in steel Nos. 1 to 17 to a treatment usually used for the manufacture of blackplates from the conventional rimmed steel or capped steel. However, there is no description concerning how to precisely select the chemical composition of the slab in order to produce the steel plate having a predetermined hardness from T-1 grade to T-6 grade and also there is no description relating to a coiling temperature range at the hot rolling step in conjunction with a chemical composition even if such a chemical composition is previously set. As a result, there are caused the large scattering in the hardness of the steel plate manufactured by the method of this literature. Furthermore, the inventors have confirmed from experiments as mentioned below that when the coiling treatment is carried out at a preferable coiling temperature of 580°–680° C. disclosed in this literature, the corrosion resistance of the resulting tinplate lowers.

It is, therefore, an object of the invention to eliminate the aforementioned drawbacks of the conventionally known method of manufacturing low temper blackplates from continuously cast slabs by continuous annealing process and to provide a method of manufacturing improved T-3 grade low temper blackplates.

According to the invention, there is the provision of a method of manufacturing T-3 grade low temper blackplates having an excellent corrosion resistance by continuous annealing process, characterized in that after a continuously cast slab of low carbon aluminum killed steel consisting of 0.02–0.09% of carbon, not more than 0.04% of silicon, 0.15–0.40% of manganese, 0.003–0.02% of soluble aluminum, not more than 0.0040% in total of nitrogen and the balance of iron and inevitable impurities is subjected to hot rolling, coiled at a temperature of not less than 500° C. but less than 580° C., pickled and subjected to cold rolling, the resulting cold-rolled strip is subjected to such a continuous annealing in a continuous annealing furnace that the strip is maintained at a temperature of not less than 680° C. for a time of not less than 20 seconds, quenched up to a temperature below 500° C. at a cooling rate of 10°–500° C./sec, maintained at a temperature of 350°–500° C. for a time of not less than 20 seconds and cooled to room temperature.

The invention will now be described with reference to the accompanying drawings, wherein.

Figure 1:
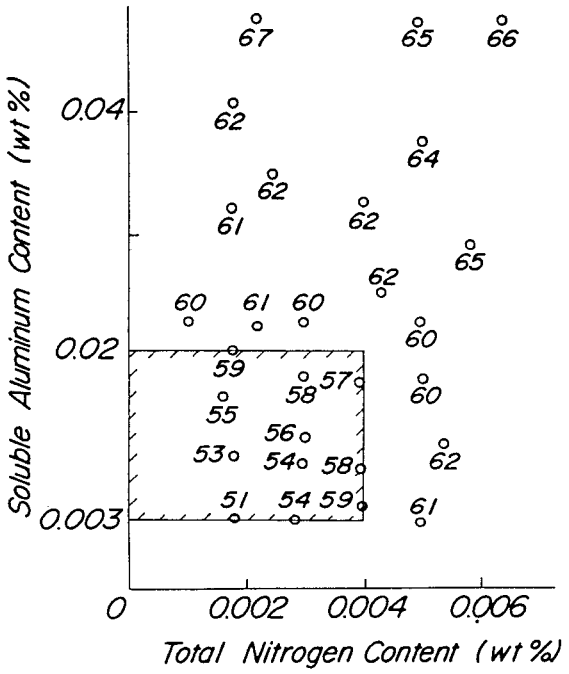
FIG. 1 is a graph showing a relation between the contents of soluble aluminum and total nitrogen in the tinplate and the Rockwell hardness ($H_R$ 30T)

The invention will now be described in greater detail below.

The steel slab used in the invention is produced by a continuous casting process using molten steel tapped from a usual smelting furnace such as converter, electric furnace or the like and is necessary to have a chemical composition as defined above.

According to the invention, the reason for limiting the chemical composition of the slab to the above defined ranges is as follows:

In general, it is considered that carbon is apt to soften steel as its content decreases. When the carbon content is not more than 0.10%, the hardness becomes lowest at a carbon content of about 0.06%. The inventors have newly found that the coiling temperature at hot rolling step largely influences on the softening of steel. Under such situations, when the carbon content is less than 0.02% or more than 0.09%, the predetermined hardness of T-3 grade can not be obtained, so that the carbon content is necessary to be within a range of 0.02–0.09%.

Silicon is incorporated into molten steel by reducing refractory used in steel making step with aluminum existent in molten steel. As the silicon content increases, the hardness of steel material after cold-rolled and annealed increases. Therefore, the upper limit of silicon content is necessary to be 0.04%.

Manganese is necessary to be not less than 0.15% in order to prevent red-shortness by sulfur at hot rolling step. As the manganese content increases, the steel material is apt to be hardened, so that the upper limit of the manganese content is necessary to be 0.40%.

Soluble aluminum is an effective element for reducing not only the hardness after continuously annealed but also the hardening after surface treatment. When the soluble aluminum is less than 0.003%, the deoxidation of molten steel is insufficient, so that it is difficult to continuously cast molten steel and at the same time blow holes are produced in the continuously cast slab. While, the soluble aluminum of more than 0.02% is not required in view of the deoxidation of molten steel and reduces the crystal grain size to make the resulting blackplate harder. Therefore, the soluble aluminum content is necessary to be within a range of 0.003–0.02%.

Nitrogen is included in an amount of about 40 ppm as far as special cares are not taken in the steelmaking step and brings about age hardening when nitrogen is existent in the form of solid solution. Now, when the total nitrogen content is more than 0.0040%, the addition of aluminum is required for reducing solid solution of nitrogen, and as a result the precipitation amount of AlN increases to obstruct the growth of crystal grain of steel, resulting in the increase of the hardness. Therefore, the total nitrogen content is necessary to be not more than 0.0040%. Moreover, when the difference between the total nitrogen content and nitrogen content of AlN exceeds 0.0020%, the age hardening becomes large, so that the difference between the total nitrogen content and nitrogen content of AlN is necessary to be not more than 0.0020% taking no great notice of age hardening.

As the inevitable impurity, mention may be made of phosphorus, sulfur and oxygen. Phosphorus contained in steel tends to harden the steel material and is preferable to be not more than 0.02%. Sulfur is apt to cause red-shortness and is preferable to be not more than 0.02%. Oxygen is included in steel as oxides such as $Al_2O_3$ and the like, which are exposed on the surface of the blackplate and are apt to produce pin holes in its surface, so that it is preferable to be not more than 0.0050%.

Next, the invention will be described with reference to experimental data.

(A) Relation between proper soluble aluminum content and total nitrogen content

In order to clarify the relation between proper soluble aluminum content and total nitrogen content, Al killed steels containing 0.05% of carbon were tapped from a converter by varying the soluble aluminum content from 0.003% to 0.05% and the total nitrogen content from 0.002% to 0.006%, respectively, and continuously cast to form slabs. Each of these slabs was hot-rolled into a strip of 2.6 mm thick at a finishing temperature of 830°–890° C. and a coiling temperature of 550° C., which was pickled and cold-rolled into a strip of 0.32 mm thick. Then, the cold-rolled strip was subjected to such a continuous annealing that the strip was heated at 710° C. to perform recrystallization annealing, quenched from 710° C. to 500° C. at a cooling rate of 50° C./sec and overaged at 400° C. for 1 minute, and then subjected to temper rolling at a reduction ratio of 1%, which was passed through a halogen-type electrolytic tin plating line to produce a tinplate. The hardness, i.e. Rockwell hardness ($H_R$ 30T) was measured with respect to the thus obtained tinplates to obtain a result as shown in FIG. 1 together with the soluble aluminum content and total nitrogen content. In FIG. 1, a shadowed region shows low temper tinplates having a tempering degree of not more than T-3 grade wherein $H_R$ 30T is not more than 60. In the tinplate included in the shadowed region, the soluble aluminum content and total nitrogen content were not more than 0.02% and not more than 0.004%, respectively. That is, it has been ascertained that when the total nitrogen content exceeds 0.004%, the hardness becomes considerably higher and the low temper tinplate can not be manufactured. This is considered to be due to the fact that the increase of solid-soluted nitrogen, aluminum and AlN considerably obstructs the growth of crystal grains in a short-time annealing such as continuous annealing or the like and consequently the resulting blackplate is not made soft. From this experiment, it has been confirmed that the soluble aluminum content and total nitrogen content in the continuously cast slab to be used should be limited to 0.003–0.02% and not more than 0.004%, respectively.

Figure 2:
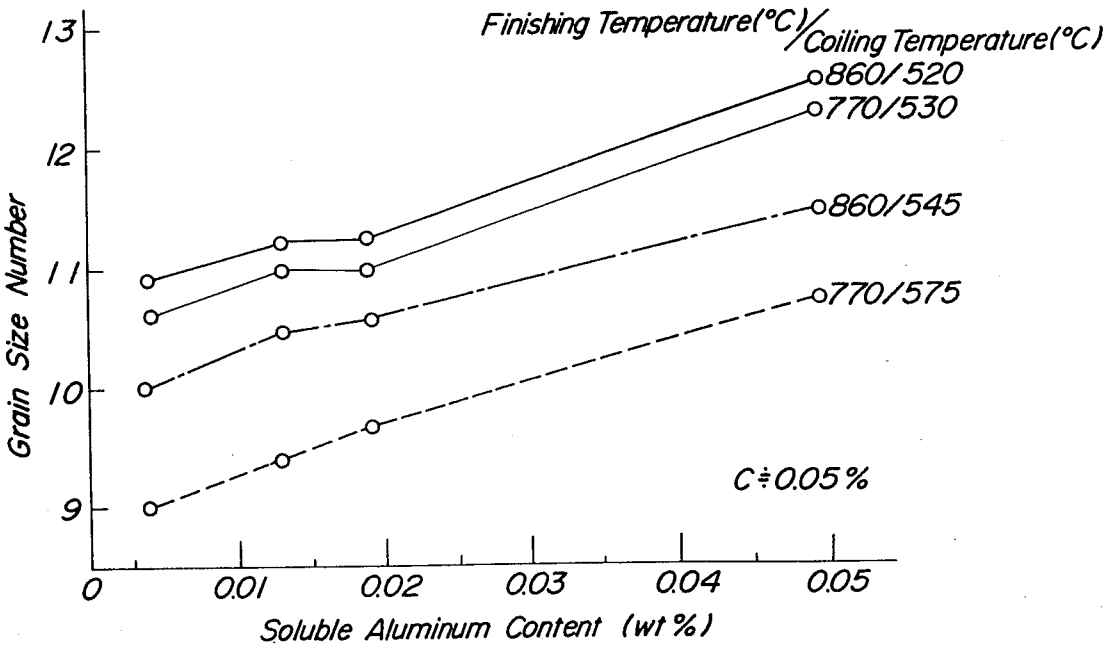
FIG. 2 is a graph showing a relation between the content of soluble aluminum and the grain size number in the blackplate containing about 0.05% of carbon when varying the finishing temperature and coiling temperature at hot rolling step.

(B) Relation between soluble aluminum content and crystal grain size after recrystallization As a factor controlling the hardness of tinplate, there are considered strain age-hardening by solid-soluted carbon or nitrogen, crystal grain size and the like. In general, it is known that the crystal grain size becomes large as the carbon content decreases and the coiling temperature at hot rolling step increases. Further, it has been ascertained from results of experiments made by the inventors that the crystal grain size largely depends upon the aluminum content. The relation between the soluble aluminum content and the crystal grain size after recrystallization as a grain size number is shown in FIG. 2 under every hot rolling and coiling condition, from which it is understood that the crystal grain size increases with the decrease of the soluble aluminum content under any hot rolling and coiling conditions. This fact is considered to be due to the fact that the growth of crystal grains is obstructed by the precipitation of AlN before the starting of recrystallization. Further, the crystal grain size becomes larger at any soluble aluminum content when the coiling temperature is higher at the same level of the finishing temperature or when the finishing temperature is lower at the same level of the coiling temperature. The former case results from the grain growth due to self-annealing, while the latter case results from the temperature of hot-rolled strip passing through a final stand of a hot finish rolling machine, i.e. the temperature of $\gamma$-region or $\alpha+\gamma$-eutectoid region.

From the above, it is confirmed that the use of killed steels having a less regulated soluble aluminum content is essential in order to provide a low temper tinplate.

(C) Relation between proper carbon content and coiling temperature

Figure 3:
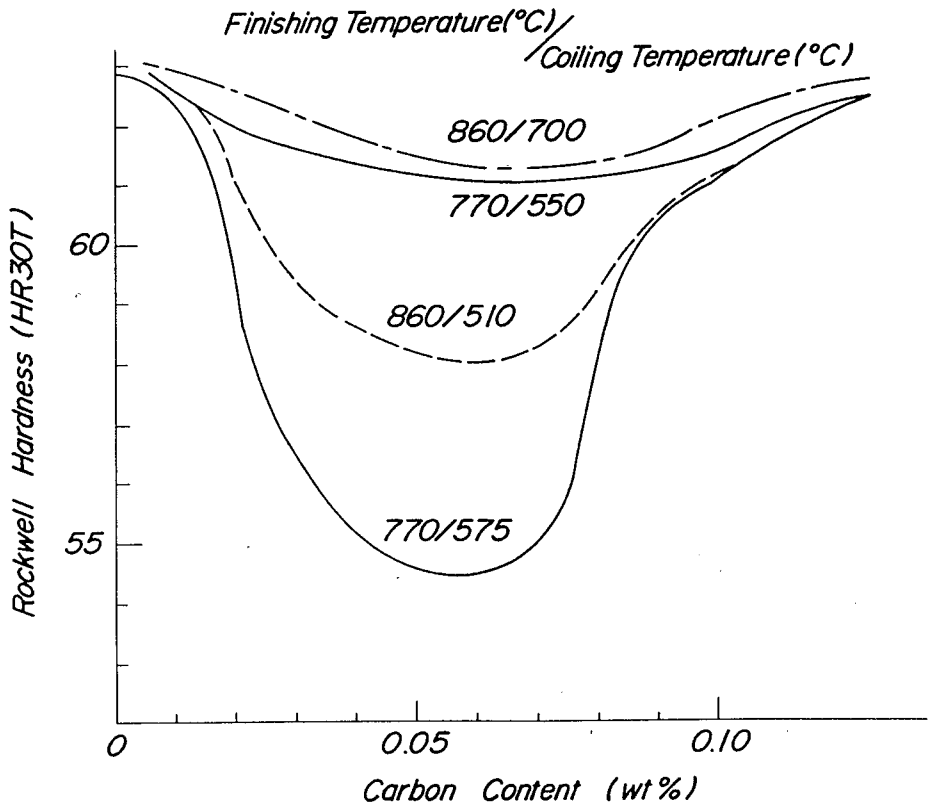
FIG. 3 is a graph showing a relation between the content of carbon and the Rockwell hardness ($H_R$ 30T) in the blackplate when varying the finishing temperature and coiling temperature at hot rolling step.

In general, it is considered that low temper blackplates are obtained as the carbon content of steel decreases. However, the inventors have found from various experimental results that when the carbon content is not more than 0.1%, the decrease of carbon content does not cause the reduction of hardness of blackplate, but rather the hardness is lowest in the blackplate containing about 0.06% of carbon and also the coiling temperature at hot rolling step has a significant influence upon the hardness of blackplate. Moreover, it has been confirmed that the hardness of blackplate does not always lower as the coiling temperature rises, and also when the carbon content is the same, the lowest temper blackplate is obtained at the coiling temperature of about 580° C. Because, when the carbon content is small, the amount of cementite as a precipitation nucleus reduces, i.e. nucleus required for precipitation of solid solution becomes smaller, so that in the short-time annealing such as continuous annealing, solid-soluted carbon remains in the blackplate without precipitation even when being subjected to an overaging treatment. On the other hand, when the coiling temperature is too high, the self-annealing of hot-rolled coil makes sufficient progress to agglomerate and coarsen carbides, so that the precipitation moving distance of carbon solid-soluted in blackplate becomes longer and the solid-soluted carbon is not sufficiently precipitated. Such a relation is shown in FIG. 3.

(D) Recrystallization annealing and overaging conditions

The heating condition at recrystallization annealing step has been described in the previous item for the formation of AlN from solid-soluted nitrogen. However, sufficiently low temper blackplates can not be obtained only by restricting the chemical composition of the raw material and the coiling temperature at hot rolling step because the age hardening of the blackplate is also related to solid-soluted carbon. Now, it has been found that it is necessary to perform the annealing process under proper conditions as mentioned below.

In order to determine proper recrystallization annealing conditions, the experiment was made by using slabs having a proper chemical composition defined in the items (A), (B) and (C) and changing the annealing temperature within a range of 600°–850° C. and also the Rockwell hardness ($H_R$ 30T) was measured after annealed. In this case, the retention time at a predetermined annealing temperature was 20 seconds. The measured results are shown in FIG. 4.

Figure 4:
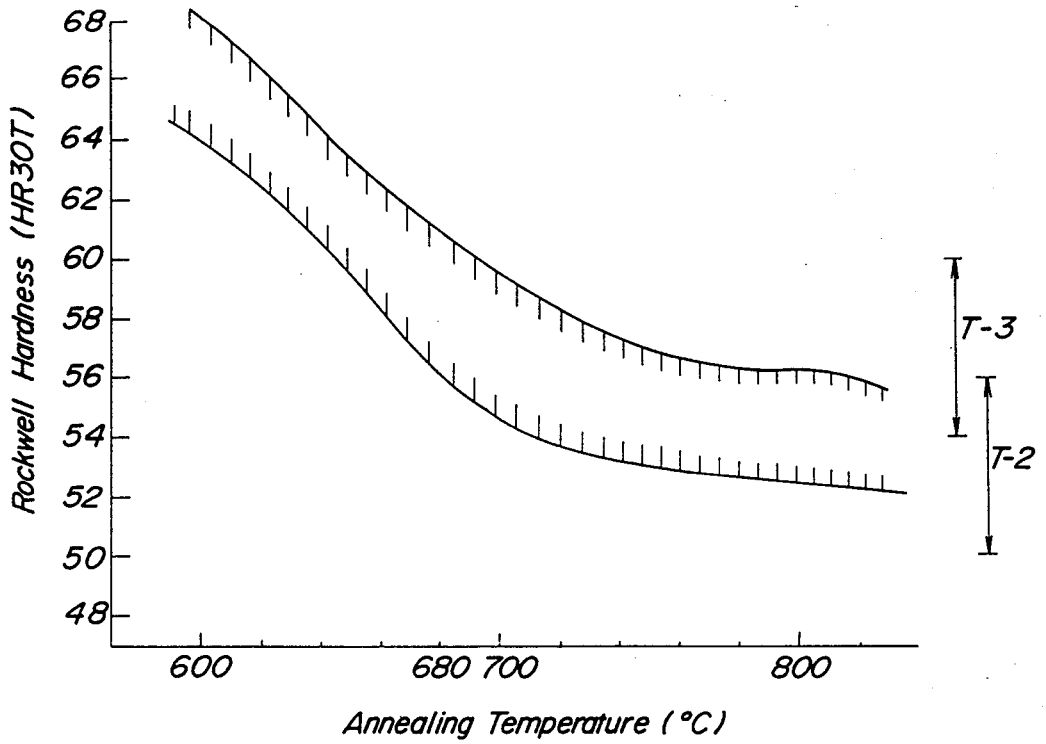
FIG. 4 is a graph showing between the Rockwell hardness ($H_R$ 30T) and the annealing temperature of the blackplate.

As apparent from FIG. 4, sufficiently soft blackplates having $H_R$ 30T of not more than 60 are obtained when the annealing temperature is not less than 680° C. Further, it has been confirmed that the blackplate is sufficiently recrystallized and made soft when the annealing temperature of not less than 680° C. is maintained for a time of at least 20 seconds.

As to quenching condition after the recrystallization annealing, it is necessary to quench up to a temperature below 500° C. at a cooling rate of 10° C./sec–500° C./sec in order to shorten the subsequent overaging time, which is due to the following reasons. That is, when the cooling rate is less than 10° C./sec, cementite precipitates halfway during the quenching to lower supersaturation degree of carbon and consequently the subsequent overaging does not make progress sufficiently. While, when the cooling rate exceeds 500° C./sec, the surface retention of the resulting blackplate deteriorates considerably. Moreover, when the quenching is stopped at a temperature over 500° C., the degree of solid solution of carbon reduces near the equilibrium solubility of carbon in ferrite at this temperature, which prevents the progress of the overaging. Accordingly, the quenching after the recrystallization annealing should be performed at a cooling rate of 10°–500° C./sec up to a temperature below 500° C.

As to overaging condition, the quenched strip should be maintained at a temperature of 350°–500° C. for a time of at least 20 seconds due to the following reasons. That is, when the temperature is less than 350° C., the diffusion rate of carbon is small and the overaging does not make sufficient progress, while when the temperature exceeds 500° C., the solid solution limit of carbon becomes larger and the amount of solid-soluted carbon can not be suppressed low. Furthermore, when the retention time is less than 20 seconds, the overaging is not completed sufficiently.

(E) Influence of coiling temperature upon corrosion resistance of tinplate

When the coiling temperature of hot-rolled strip rises as mentioned above, oxide film produced on the surface of the strip consists mainly of magnetite ($Fe_3O_4$) and becomes dense, so that the descaling property extremely lowers. As a result, when this strip is pickled at substantially the same pickling rate as used in the usually hot-rolled steel plate, the descaling is poor, which is apt to produce surface defects on a final product. Such surface defects are fatal in tinplates because the surface properties are a matter of great importance to the tinplate.

Furthermore, when the coiling temperature becomes higher, carbide existent in the hot-rolled strip results in a structure agglomerated in grain boundary or grains of ferrite without being finely precipitated in the ferrite. This structure is maintained from the cold rolling step to the plating step through the annealing and temper rolling steps. That is, when the carbide is existent at the agglomerated and coarsened state in the surface of the blackplate after pickling prior to plating, it does not carry electric current, so that when the blackplate is subjected to a tin plating treatment and further to a usual reflowing treatment (or alloying treatment) by electric heating, metallic tin is not remelted at the carbide-existing portion, and as a result a dense alloyed layer can not be obtained and hence the resulting tinplate is poor in the corrosion resistance. From this fact, it will easily be understood that the corrosion resistance becomes poor in the tinplate treated at a temperature of 580°-680° C. which is a preferable coiling temperature described in Japanese Patent Application Publication No. 48,574/80.

Figure 5:
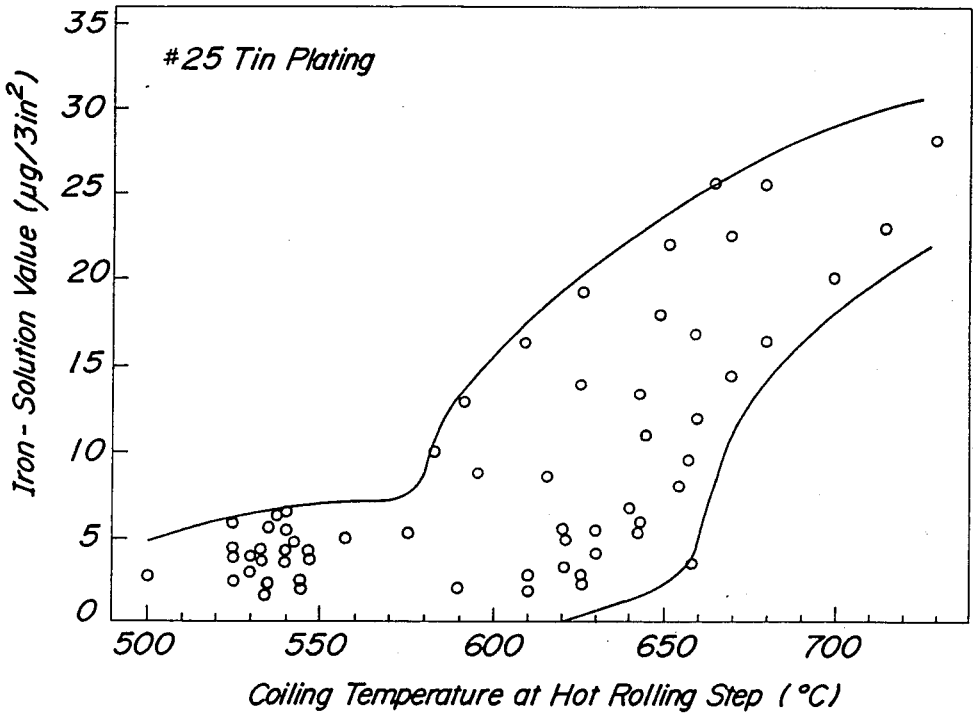
FIG. 5 is a graph showing a relation between the coiling temperature of the hot-rolled strip and the iron-solution value.

This relation is shown in FIG. 5, from which it is understood that when the coiling temperature at hot rolling step is higher than 580° C., the iron-solution value extremely increases, resulting in considerable degradation of corrosion resistance of tinplate. Further, the presence of agglomerated and coarsened carbide was observed in the blackplate treated at the coiling temperature above 580° C. but not observed at the coiling temperature of less than 580° C.

The term "iron-solution value" used herein means the amount of iron dissolved out from a test piece of tinplate under simulated canning reaction conditions for the measurement of corrosion resistance in the surfaces of blackplates and tinplates, from which the corrosion resistance can be evaluated.

The finishing temperature at the hot rolling step is not particularly critical, but it is preferably 750°-900° C. And also, the reduction ratio at the cold rolling step is not particularly critical, but it is usually 75-95%.

The inventors have found that low temper tinplate products having a hardness below T-3 grade and excellent workability and corrosion resistance can be obtained when the blackplates after the continuous annealing and overaging at the above mentioned conditions are subjected to temper rolling and tin plating, and as a result the invention has been accomplished.

The differences between the invention and Japanese Patent Application Publication No. 48,574/80 are summarized as follows.

The inventors have made studies in detail with respect to the manufacturing conditions exerting upon the hardness of tinplate and newly found that the hardness of tinplate is controlled by solid-soluted carbon, crystal grain size and solid-soluted nitrogen (difference between total nitrogen content and nitrogen content of AlN) in this order, and that it is necessary to limit the carbon content within an optimum range because the influence of solid-soluted carbon is greatest, and that the hardness becomes higher when the coiling temperature is extremely high. That is, since the short-time annealing such as continuous annealing or the like can not take a cooling time enough to precipitate the solid-soluted carbon, the annealed blackplate is further subjected to an overaging treatment, but even in this case the solid-soluted carbon remains in the blackplate without being sufficiently precipitated, which makes the blackplate hard. Therefore, the presence of nucleus is required for accelerating the precipitation of solid-soluted carbon at the continuous annealing and cooling step, which is a cementite. On the other hand, since the cooling time after the continuous annealing is short, a movable distance of the solid-soluted carbon is short, so that it is advantageous that the nuclei are densely distributed in the blackplate in order to sufficiently precipitate the solid-soluted carbon. As a result, it is necessary to produce a blackplate containing finely distributed cementite as a nucleus before the continuous annealing. For this purpose, it has newly been found that the carbon content is necessary to be as relatively high as 0.02-0.09%. In this connection, the above literature only discloses that the carbon content is not more than 0.12% but does not teach nor suggest that the carbon content range defined in the invention is most preferable in the manufacture of low temper blackplates. Furthermore, the inventors have found that cementite is agglomerated and coarsened as the coiling temperature rises, i.e. the cementite begins to agglomerate above 580° C. and to coarsen above 640° C. In this connection, the literature discloses that the coiling temperature is not less than 550° C., preferably 580°-680° C. However, such a higher coiling temperature causes the formation of the agglomerated and coarsened cementite as described above, which not only considerably degrades the corrosion resistance but also deteriorates the descaling property because the scaled layer of hot-rolled blackplate becomes thicker. From this fact, it has newly been found that the coiling temperature should be less than 580° C.

The invention will be explained more clearly by means of examples.

EXAMPLE 1

A steel specimen having a chemical composition as shown in the following Table 1 was tapped from a converter and then continuously cast to form a slab. In this case, extremely-low carbon steels having a carbon content of not more than 0.03% were decarburized by a vacuum degassing treatment. The resulting slab of Specimen Nos. 1-4 and 6-14 were hot-rolled into a strip of 2.6 mm thick at a finishing temperature of 830°-895° C. and a coiling temperature of 500°-730° C. and then cold-rolled into a strip of 0.32 mm thick.

The thus cold-rolled strip was subjected to such a continuous annealing that the strip was maintained at a temperature of 710° C. for 20 seconds, quenched up to 400° C. at a cooling rate of 50° C./sec, maintained at 400° C. for 20 seconds and then cooled to room temperature.

Then, the thus obtained blackplate was subjected to temper rolling at a reduction ratio of 1.0% and further to #25 tin plating and usual reflowing treatment at a halogen-type electrolytic tin plating step.

The hardness and iron-solution value evaluating the corrosion resistance were measured to obtain results as shown in the following Table 2.

TABLE 1

| Specimen No. | Chemical composition (weight %) | | | | | | | |
|---|---|---|---|---|---|---|---|---|
| | C | Si | Mn | P | S | solAl | N | O |
| Invention steel | | | | | | | | |
| 1 | 0.022 | 0.034 | 0.23 | 0.018 | 0.013 | 0.017 | 0.0034 | 0.0032 |
| 2 | 0.023 | 0.002 | 0.27 | 0.014 | 0.014 | 0.016 | 0.0035 | 0.0027 |
| 3 | 0.030 | 0.012 | 0.27 | 0.015 | 0.019 | 0.014 | 0.0026 | 0.0024 |
| 4 | 0.045 | 0.014 | 0.28 | 0.019 | 0.018 | 0.018 | 0.0032 | 0.0033 |
| 6 | 0.065 | 0.023 | 0.38 | 0.017 | 0.017 | 0.010 | 0.0022 | 0.0032 |
| 7 | 0.076 | 0.006 | 0.24 | 0.009 | 0.013 | 0.012 | 0.0025 | 0.0019 |
| Control steel | | | | | | | | |
| 8 | 0.011 | 0.033 | 0.32 | 0.016 | 0.013 | 0.018 | 0.0037 | 0.0032 |
| 9 | 0.042 | 0.032 | 0.34 | 0.018 | 0.009 | 0.016 | 0.0054 | 0.0024 |
| 10 | 0.053 | 0.014 | 0.25 | 0.017 | 0.014 | 0.048 | 0.0028 | 0.0022 |
| 11 | 0.093 | 0.006 | 0.22 | 0.019 | 0.009 | 0.017 | 0.0025 | 0.0045 |
| 12 | 0.022 | 0.033 | 0.22 | 0.018 | 0.014 | 0.005 | 0.0021 | 0.0045 |
| 13 | 0.053 | 0.024 | 0.31 | 0.016 | 0.017 | 0.018 | 0.0035 | 0.0028 |
| 14 | 0.076 | 0.007 | 0.25 | 0.010 | 0.013 | 0.019 | 0.0038 | 0.0020 |

TABLE 2

| | Specimen No. | Hot rolling condition: Finishing temperature °C. | Hot rolling condition: Coiling temperature °C. | Pickling property | Solid-soluted nitrogen ppm | Hardness of tinplate $H_R$ 30T | Corrosion resistance of tinplate |
|---|---|---|---|---|---|---|---|
| Invention steel | 1 | 895 | 520 | o | 12 | 59 | o |
| | 2 | 890 | 530 | o | 13 | 59 | o |
| | 3 | 885 | 560 | o | 9 | 57 | o |
| | 4 | 885 | 560 | o | 15 | 56 | o |
| | 6 | 840 | 510 | o | 13 | 58 | o |
| | 7 | 835 | 575 | o | 10 | 58 | o |
| Control steel | 8 | 830 | 580 | o | 25 | 62 | o |
| | 9 | 890 | 500 | o | 32 | 62 | o |
| | 10 | 860 | 520 | o | 19 | 61 | o |
| | 11 | 850 | 560 | o | 11 | 62 | o |
| | 12 | 890 | 600 | Δ | 8 | 59 | Δ |
| | 13 | 845 | 660 | X | 20 | 57 | x |
| | 14 | 830 | 730 | X | 15 | 58 | X |

Note: Evaluation of pickling property
o: pickled in high efficiency
Δ: pickling efficiency somewhat reduced
X: pickling efficiency reduced below 50%
Corrosion resistance of tinplate
o: acceptable for use in high anticorrosion container
Δ: acceptable for use in general container
x: acceptable for use in miscellaneous containers
X: unacceptable for use in miscellaneous containers In Table 1, the underlined values of Specimen Nos. 8–11 are outside the ranges defined in the invention.

As apparent from Table 2, when using steels of Specimen Nos. 1–4 and 6–7 according to the invention, the resulting tinplate products have a tempering degree ($H_R$ 30T) of not more than 60 showing a low temper tinplate and are excellent in the corrosion resistance. On the contrary, when using control steels of Specimen Nos. 8–11 with a chemical composition being outside the ranges defined in the invention, all of the resulting tinplates become hard because the tempering degree ($H_R$ 30T) is more than 60, but they are good in the corrosion resistance because the coiling temperature at hot rolling step is not more than 580° C. On the other hand, when using control steels of Specimen Nos. 12–14 with a chemical composition being within the ranges defined in the invention at a coiling temperature of more than 580° C., all of the resulting tinplates become soft because the tempering degree ($H_R$ 30T) is not more than 60, but they are poor in the corrosion resistance because the iron-solution value is high.

EXAMPLE 2

The same procedure as described in Example 1 was repeated except that the finishing temperature at hot rolling step was 760°–790° C. lower than that of Example 1 in order to obtain a softer plate and then the tempering degree ($H_R$ 30T) and iron-solution value evaluating the corrosion resistance were measured to obtain results as shown in the following Table 3.

TABLE 3

| | Specimen No. | Hot rolling condition: Finishing temperature °C. | Hot rolling condition: Coiling temperature °C. | Pickling property | Solid-soluted nitrogen ppm | Hardness of tinplate $H_R$ 30T | Corrosion resistance of tinplate |
|---|---|---|---|---|---|---|---|
| Invention steel | 1 | 765 | 570 | o | 15 | 56 | o |
| | 2 | 760 | 575 | o | 14 | 56 | o |
| | 3 | 780 | 555 | o | 10 | 55 | o |
| | 4 | 765 | 555 | o | 16 | 54 | o |
| | 6 | 795 | 510 | o | 15 | 56 | o |
| | 7 | 790 | 575 | o | 12 | 56 | o |
| Control steel | 8 | 765 | 580 | o | 27 | 59 | o |
| | 9 | 755 | 510 | o | 36 | 59 | o |
| | 10 | 780 | 500 | o | 21 | 58 | o |
| | 11 | 790 | 560 | o | 14 | 61 | o |
| | 12 | 760 | 600 | Δ | 7 | 56 | Δ |
| | 13 | 770 | 670 | X | 22 | 52 | x |
| | 14 | 785 | 730 | X | 18 | 56 | X |

Note: Evaluation of pickling property
o: pickled in high efficiency
Δ: pickling efficiency somewhat reduced
x: pickling efficiency reduced below 50%
Corrosion resistance of tinplate
o: acceptable for use in high anticorrosion container
Δ: acceptable for use in general container
x: acceptable for use in miscellaneous containers
X: unacceptable for use in miscellaneous containers As apparent from Table 3, when using steels of Specimen Nos. 1–4 and 6–7 according to the invention, tinplate products having a hardness below T-3 grade ($H_R$ 30T:52~58) and an excellent corrosion resistance can be manufactured. On the contrary, when using the control steels of Specimen Nos. 8–11, the resulting tinplates are fairly hard as compared with those according to the invention, while when using the control steels of Specimen Nos. 12–14, the low temper tinplates can be manufactured, but they are fairly poor in the corrosion resistance.

As apparent from the above examples, the invention can realize the following great merits by using continuously cast slabs having particular defined contents of carbon, soluble aluminum and total nitrogen, limiting the coiling temperature at hot rolling step to less than 580° C., properly controlling the continuous annealing conditions and performing the subsequent overaging treatment at a proper temperature.

(a) Low temper tinplates, whose hardness expressed by $H_R$ 30T according to JIS G 3303 is not more than T-3 grade can always be manufactured stably.

(b) According to the invention, the coiling temperature at hot rolling step is limited to less than 580° C., so that the descaling is easy and consequently the hot-rolled strip can be passed through a pickling line at a usual speed, and also carbide existent in the hot-rolled strip is finely precipitated in ferrite and hence the corrosion resistance of the resulting tinplate can be improved.

(c) The invention utilizes a most preferable method for the manufacture of low temper tinplates, i.e. a continuous annealing process using continuously cast slab, so that not only the material of the strip is homegeneous in its longitudinal and widthwise directions, but also the productivity is considerably improved as compared with the conventional box annealing process and hence the production cost can largely be reduced.

(d) Low temper tinplates obtained by the method according to the invention are not only excellent in the workability but also considerably good in the shape retention and surface properties.

(e) The aluminum content in continuously cast slab used for the invention is small, so that the metallic aluminum quantity used in steelmaking process may be reduced.

Although the invention has been described with respect to only the manufacture of tinplates, other modifications may be devised by those skilled in the art without departing from the scope of the invention. For instance, if it is intended to manufacture tin free steel plates by using the blackplates according to the invention, lower temper tin free steel plates can easily be manufactured because there is not increase of hardness due to the reflowing treatment at the manufacturing step of tinplates.

What is claimed is:

1. A method of manufacturing T-3 grade low temper black plates, having an excellent corrosion resistance and a HR 30T of not less than 52 but not more than 60, by a continuous annealing process, which method comprises, after subjecting to hot rolling, a continuously cast slab of low-carbon aluminum killed steel consisting of 0.02–0.09% carbon, not more than 0.04% of silicon, 0.15–0.40% of manganese, 0.01–0.015% of soluble aluminum, not more than 0.0035% in total of nitrogen and the balance of iron and inevitable impurities, coiling the hot-rolled slab at a temperature of not less than 500° C. but less than 580° C., pickling the coiled slab and then subjecting the same to cold rolling, subjecting the cold-rolled slab to such a continuous annealing in a continuous annealing furnace that the slab is maintained at a temperature of not less than 680° C. for a time of not less than 20 seconds, quenching up the slab to a temperature below 500° C. at a cooling rate of 10°–500° C./sec, maintaining the slab at a temperature of 350°–500° C. for a time of not less than 20 seconds, and cooling the slab to room temperature.

* * * * *